United States Patent [19]

Fincke et al.

[11] 4,051,449

[45] Sept. 27, 1977

[54] TIME FREQUENCY DIVERSITY SYSTEM

[75] Inventors: George C. Fincke, West Allenhurst; George W. Taylor, Brielle, both of N.J.

[73] Assignee: The United States of America as represented by the Secretary of the Army, Washington, D.C.

[21] Appl. No.: 731,159

[22] Filed: Oct. 12, 1976

[51] Int. Cl.[2] ..... H01P 1/20; H01P 7/04; H01P 3/08

[52] U.S. Cl. ..... 333/73 C; 333/82 B; 333/84 R; 333/97 R

[58] Field of Search ..... 333/73 W, 73 R, 73 C, 333/73 S, 82 B, 82 R, 97 R, 97 S, 1, 7 R, 2, 7 D, 17 R, 17 M, 84 R, 84 M; 334/41–45; 330/53, 56; 331/101

[56] References Cited

U.S. PATENT DOCUMENTS

| | | | |
|---|---|---|---|
| 3,131,365 | 4/1964 | Hoover | 333/97 S X |
| 3,452,293 | 6/1969 | Delong et al. | 333/82 B |
| 3,602,848 | 8/1971 | Leonard | 333/73 C |
| 3,889,214 | 6/1975 | Petitjean et al. | 333/73 W X |
| 3,969,681 | 7/1976 | Fincke | 330/56 |

*Primary Examiner*—Harold A. Dixon
*Assistant Examiner*—Marvin Nussbaum
*Attorney, Agent, or Firm*—Nathan Edelberg; Jeremiah G. Murray; Bernard Franz

[57] ABSTRACT

A plurality of signals to be separated in time as well as in frequency are simultaneously applied to the input of a power amplifier whose output is applied to the input of a fast-tuned filter. The filter is capable of being almost-instantaneously tuned to any of the frequencies of the input signals to control the output at any given time or combinations of times. The filter is in the form of a coaxial section with an input to the inner conductor of the coaxial section and the output taken from a strip line, parallel to the inner coaxial conductor, coupled to a coaxial output cable at the top of the coaxial filter. The tuning is by a plurality of inductive spokes positioned at various locations within the filter, and connected between the inner and outer coaxial conductors by switching diodes, that are externally controlled, to provide almost instantaneous control of the resonant frequency of the filter.

10 Claims, 4 Drawing Figures

FIG. 1
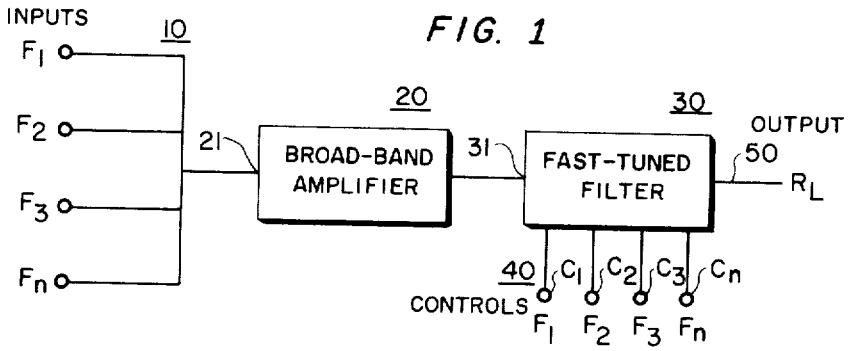
FIG. 3
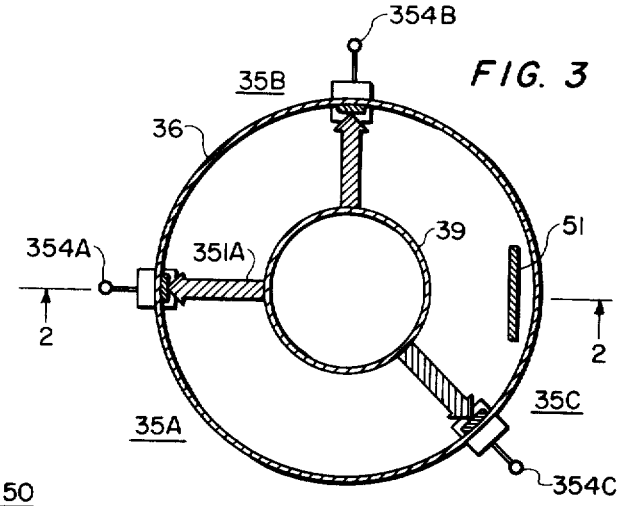
FIG. 2
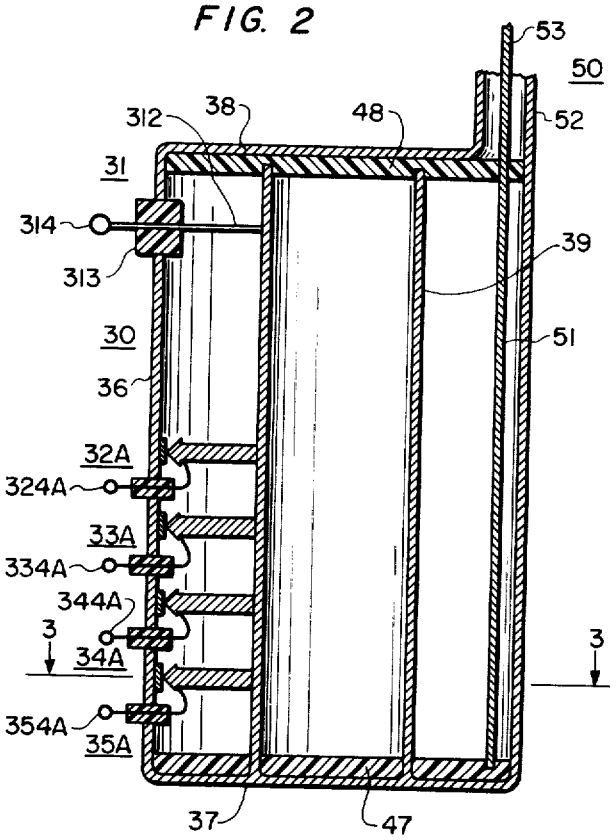
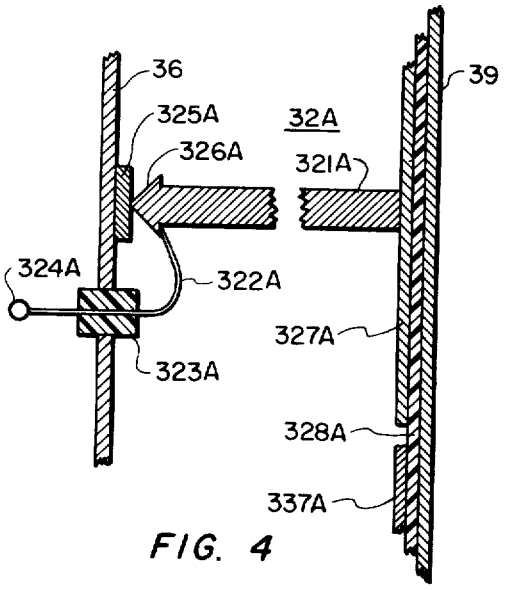
FIG. 4

TIME FREQUENCY DIVERSITY SYSTEM

The invention described herein may be manufactured, used and licensed by or for the Government for governmental purposes without the payment to us of any royalties thereon.

CROSS REFERENCE TO RELATED APPLICATIONS

A device having an amplifier tube combined with tuned strips switched by diodes, or mounted within a tuned coaxial cavity that includes a single level of diode-shortable spokes, is seen in the co-pending application of George Fincke, Ser. No. 497,788 for a "Fast Electronic Tuning of High Power Circuits for VHF-UHF Power Amplifiers at High Efficiency", filed Aug. 15, 1974 and now U.S. Pat. No. 3,969,681, issued July 13, 1976.

Another device for combining several signals, using similarly tuned coaxial sections, is seen in our co-pending application, Ser. No. 731,158, filed Oct. 12, 1976, for a "Fast-Tuned, Multiplexer Power Combiner".

BACKGROUND OF THE INVENTION

Time division of signals is well known and is used for the separation of discrete bits of information, usually from separate sources, to transmit them over a single output facility in a time pattern. Depending on the usage, the bits of information may all be applied to a given output frequency for radio frequency transmission, or they may be transmitted at separate frequencies in the desired time sequence. Normally the sources of input signals will have to be switched on or off separately to achieve the time multiplexing of the separate sources of bits or data. There is very little, if anything, available that can switch the combined signals at the output of an amplifier, let alone the frequencies at the required rates, or handle the amounts of power that may be involved.

SUMMARY OF THE INVENTION

Several signals at differing frequencies are simultaneously applied to a broad band amplifier for amplification. The output of the amplifier is applied to a fast-tuned filter whose output may be transmitted in any desired manner. The filter is coaxial with an input connection through the outer conductive casing of the coaxial filter to the top of the inner coaxial conductor. The output of the filter is taken from a strip line, inductively coupled to the inner coaxial conductor, connected to a coaxial output cable at the top of the coaxial filter. The coaxial filter is tuned by a series of inductive spokes positioned at various intervals between the inner and outer coaxial conductors and connected between the inner and outer coaxial conductors by switching diodes, externally biased, and separately controlled to effectively connect or disconnect corresponding inductive spokes within the coaxial filter to vary the resonant frequency of the filter.

BRIEF DESCRIPTION OF THE DRAWINGS

FIG. 1 shows a block diagram of the overall system;

FIG. 2 shows a vertical cross section of a typical fast-tuned filter;

FIG. 3 shows a horizontal cross section of the same filter; and

FIG. 4 shows an enlarged detail of an inductive assembly spoke.

DESCRIPTION OF THE PREFERRED EMBODIMENT

Referring more particularly to FIG. 1, inputs $f_1, f_2, f_3$, and $f_n$ at 10 are applied to an input 21 of a broad band amplifier 20. The output of the broad band amplifier is applied to an input 31 of a fast-tuned filter 30. The output 50 of the fast-tuned filter may be applied to any suitable load RL which may be a transmission line, or transmitting antenna, not shown. The fast-tuned filter 30 has a series of control terminals $C_1$, $C_2$, $C_3$, and $C_n$ that may be controlled or actuated by any time-control switching device or systems, in any manner.

FIG. 2 shows a vertical cross section of a coaxial filter 30 including a fast-tuning system, which is the essence of this time-frequency diversity system. This cross section is taken along the lines 2—2 of FIG. 3, to be described later. The fast-tuned coaxial filter 30 has an input 31, inductive spoke assemblies 32–35 (A-C), an outer coaxial conducting or conductive casing 36, a base plate 37, a top plate 38, and an inner coaxial conductor 39. The bottom end of the inner coaxial conductor may be attached and connected to the base plate 37, and its upper end may be supported by an insulator 48. A coaxial output cable 50, has is outer coaxial conductor 52 connected to the top plate 38 and its inner coaxial output conductor 53 connected to the upper end of an output strip line 51 whose lower end is supported by an insulator 47 next to the base plate 37 of the filter.

The input 31 may have an input conductor 312 connected from the upper end of the inner coaxial conductor, through an insulator 313, to an input terminal 314.

The inductive spoke assemblies have control terminals such as 324A and other elements that will be more clearly seen in the enlarged detail of FIG. 4.

FIG. 3 shows a horizontal cross section of the device of FIG. 2 along the lines 3—3. This shows the inductive spoke assembly 35A, as well as other inductive spoke assemblies such as 35B and 35C, not seen in FIG. 2. It will be noted that the same elements in all of the figures have the same numbers, and similar elements are similarly numbered. The inductive spokes, such as 351A, and the control terminals, such as 354A are again seen but will be described in more detail in FIG. 4.

FIG. 4 shows an enlarged detail of another typical spoke assembly such as 32A. This shows the mounting-connection of a typical inductive spoke 321A with a bias conductor 322A extending through an insulated from the other coaxial conductor 36 by an insulator 323A to connect with a control terminal 324A. The mounting-connection of the diode anode 325A, of a switching diode, to the outer coaxial conductor, as well as the mounting-connection of the diode cathode 326A to the outer end of the inductive spoke is also seen.

The inner end of the inductive spoke is clearly seen to be mounted and connected to a metallic plate 327A, which is separated, by an insulating layer 328A, from the inner coaxial conductor 39. An adjacent metallic plate 337A that is part of the adjacent inductive spoke assembly 33A is also seen to be separate from the metallic plate 327A, yet may share the same insulating layer from the inner coaxial conductor 39.

In operation, the input frequencies $f_1$ to $f_n$, applied to the broad band amplifier 20, are indiscriminately amplified and applied to the fast-tuned filter 30 whose output, as noted earlier, may be to any suitable device.

The input to the fast-tuned coaxial filter 30 is applied to the input terminal 314 and through the input conductor 312 and its insulator 313 to the inner coaxial conductor 39. The signals travel down the coaxial filter in a well known TEM mode to selectively resonate at the natural frequency of the filter without the inductive spokes, or at a frequency determined by the inductive spokes. The selected signal in the coaxial filter is picked up by the output strip line 51, in a well known manner, to be applied to the inner coaxial conductor 53 of the coaxial output cable 50.

The tuning of the filter is accomplished by forward-or-back biasing any one or combination of the switching diodes to connect or disconnect the corresponding inductive spoke to or from the inner and outer conductors of the coaxial filter. Since the actuation of the diodes is almost instantaneous, the switching, and the resultant frequency change, is almost instantaneous, and the frequency applied to the output can be digitally programmed to fraction-of-a-second time intervals for any desired function or purpose.

The control signals applied to the terminals $C_1$ to $C_n$ of FIG. 1 will set the time sequence or pattern, in a well known manner, and the biasing of the diodes — or combinations of diodes — actuated by these controls will establish the resonant frequency of the filter for that interval of time.

The function of the coaxial filter is conventional as are the functions of its input and output connections. The input coupling may require that the inner coaxial conductor be connected to the top plate 38 to obtain the proper impedance match for the input line under certain circumstances.

The size and shape and proportions of the various elements of this device will also depend primarily on impedance matching for the coaxial filter itself as well as on the impedance matching of its input and output sections.

Any switching diodes may be used, as long as their size and shape can accommodate the structural requirements for mechanical, as well as electrical, coupling to the inductive spoke as well as to the outer conductive casing. The electrical characteristics of the switching diode must also be suitable for this function.

The inductive spokes will have a physical size and shape that is also determined by impedance matching requirements within the filter. They may be solid or hollow rods or tubes of brass or other highly-conductive material. Their placement, as well as their size and shape, will establish the effect of each spoke, or combination of spokes, on the resonant frequency of the filter. The more spokes in a filter, the finer the degree of control on the resonant frequency of the filter. However, the more spokes the more structural problems as well as electrical complexity. One would normally have a few widely-spaced spokes for wider frequency shifts, and then relatively-closely-spaced spokes for finer frequency tuning. This would apply to the spacing of the rings of inductive spoke assemblies, such as 32 to 35, as well as the spacing of the inductive spokes within the rings.

The spoke-coupling plates such as 327A and 337A should be as large as possible for good capacitive coupling to the inner coaxial conductor 39, but the spoke-coupling plates must be separated from each other, as well as the inner coaxial conductor, to permit separate biasing for each switching diode.

The upper end of the inner coaxial conductor may be isolated, from the top plate 38, as shown, or it may be connected to the top plate if this will improve the impedance match between the input 31 and the coaxial filter.

Separate insulating layers such as 328A may be provided for each separate spoke-coupling plate such as 327A, or a single insulating layer may be provided, around the inner coaxial conductor 39, to accommodate all of the spoke-coupling plates. It is essential, of course, that the inductive spokes be isolated from each other, as well as the common inner coaxial conductor, to provide individual control of all the inductive spokes.

The size and shape and the proximity of the output strip line 51 to the inner and outer coaxial conductors must also be determined by the impedance match to the other coaxial filter elements and to the coaxial output cable 50.

The size and shape and materials of the coaxial filter itself must also be established by impedance-matching requirements, and the frequencies over which this filter will be operating. The inner and outer conductors of the coaxial filter will normally be of thin-walled, highly-conductive, metallic tubing. The top and bottom plates will be electrically and mechanically connected to the outer conductive casing and may be, as noted earlier, also connected to the inner coaxial conductor.

It is to be understood that we do not desire to be limited to the exact details of construction shown and described since obvious modifications will occur to a person skilled in the art.

What is claimed is:

1. A time-frequency diversity system comprising a plurality of sources of input signals of differing frequencies; a broad band amplifier; means for coupling said plurality of sources of input signals to the input of said broad band amplifier; a fast-tuned filter; means for coupling the output of said broad band amplifier to the input of said fast-tuned filter; an output load; means for coupling the output of said fast-tuned filter to said output load; said fast-tuned filter comprising a coaxial filter; means for tuning said coaxial filter comprising a plurality of inductive spokes positioned at various intervals between the inner and the outer coaxial conductors of said coaxial filter; and means for connecting and disconnecting said inductive spokes between said inner and outer conductors of said coaxial filter.

2. A time-frequency diversity system as in claim 1 wherein said means for connecting and disconnecting said inductive spokes between said inner and outer conductors of said coaxial filter comprises a plurality of switching diodes, each one connected in series with one of said inductive spokes between said inner and outer coaxial conductors, and means for biasing said switching diodes.

3. A time-frequency diversity system as in claim 1, wherein said biasing means are connected to said diodes for switching combinations of said diodes in a given time sequence to vary the frequency of the output of said fast-tuned filter in said given time sequence.

4. A time-frequency diversity system as in claim 1 wherein said inductive spokes form a series of rings at various intervals from the base of said coaxial filter.

5. A time-frequency diversity system as in claim 4 wherein each of said rings comprises a plurality of said inductive spokes spaced at various intervals around said rings.

6. A time-frequency diversity system as in claim 2 having means for providing radio-frequency coupling between one end of each of said inductive spokes and one of said coaxial conductors; and means including one of said diodes for providing radio-frequency coupling between the other end of each of said inductive spokes and the other of said coaxial conductors; and external control means for biasing said switching diodes.

7. A time-frequency diversity system as in claim 6 having one electrode of each of said diodes physically and electrically connected to said other end of said inductive spoke; means for connecting the other electrode of each of said diodes to said outer coaxial conductor of said coaxial filter, and means for providing radio-frequency coupling between said one end of each of said inductive spokes and said inner conductor of said coaxial filter.

8. A time-frequency diversity system as in claim 7 wherein said means for providing radio-frequency coupling between said one end of each of said inductive spokes and said inner conductor of said coaxial filter consists of a spoke plate, congruent with and adjacent to said inner conductor, connected to said one end of each of said inductive spokes; and insulating means for separating said spoke plate from said inner conductor of said coaxial filter.

9. A time-frequency diversity system as in claim 7 wherein said external means for biasing said switching diodes comprises a separate bias conductor having a first and connected to each of the junctions of said one electrode of each of said diodes and said other end of said inductive spoke; a control terminal, outside of said coaxial filter, for each of said bias conductors; the second end of each of said bias conductors connected to a corresponding one of said control terminals; and means for insulating each of said bias conductors where it passes through said outer coaxial conductor.

10. A time-frequency diversity system as in claim 1 wherein said means for coupling said output of said fast-tuned filter to said output load is a coaxial conductor having an outer conductor connected to the upper end of said coaxial filter, and an inner conductor connected to the upper end of a strip line passing between said inner and outer coaxial conductors of said coaxial filter; the lower end of said strip line being connected to the lower end of said coaxial filter.

* * * * *